US005593313A

United States Patent [19]

Shibuya et al.

[11] Patent Number: 5,593,313

[45] Date of Patent: Jan. 14, 1997

[54] SOCKET WITH A PLUG LOCKING MECHANISM

[75] Inventors: Norio Shibuya; Norihiro Oura, both of Tokyo, Japan

[73] Assignee: NEC Corporation, Tokyo, Japan

[21] Appl. No.: 560,631

[22] Filed: Nov. 20, 1995

Related U.S. Application Data

[63] Continuation of Ser. No. 325,150, Oct. 20, 1994, abandoned.

[30] Foreign Application Priority Data

Nov. 25, 1993 [JP] Japan ..... 5-294978

[51] Int. Cl.[6] ..... H01R 13/62

[52] U.S. Cl. ..... 439/373; 439/372

[58] Field of Search ..... 439/372, 373, 439/345, 358

[56] References Cited

U.S. PATENT DOCUMENTS

| | | | |
|---|---|---|---|
| 4,534,608 | 8/1985 | Scott et al. | 439/345 |
| 4,588,238 | 5/1986 | Mickelson et al. | 439/345 |
| 4,643,503 | 2/1987 | Johnson et al. | 439/227 |
| 5,174,781 | 12/1992 | Muzslay | 439/372 |
| 5,183,404 | 2/1993 | Aldous et al. | 439/55 |
| 5,277,620 | 1/1994 | Taylor | 439/488 |

FOREIGN PATENT DOCUMENTS 063034811 7/1994 Japan .

*Primary Examiner*—Khiem Nguyen
*Attorney, Agent, or Firm*—Whitham, Curtis, Whitham & McGinn

[57] ABSTRACT

A socket with a plug locking mechanism has a socket body having an opening formed in a specified position. Plural receptacles for supplying electric power are exposed at their top face from the opening of the socket body and are electrically and mechanically connected with plural terminals projectively formed on the top end of a plug. Plural projecting parts are integrally formed with the same material as the socket body as keeping a specified interval between them on both sides of the opening. Each of the plural projecting parts has at least one hole. A spring has a locking part formed to be engaged with the rear part of the plug in its middle part, and is set in the plural projecting parts so as to be freely turned by inserting each end part thereof into each of the holes which are formed in each of the plural projecting parts.

10 Claims, 2 Drawing Sheets

SOCKET WITH A PLUG LOCKING MECHANISM

This is a Rule 60 continuation application of application Ser. No. 08/325,150 filed Oct. 20, 1994 now abandoned.

BACKGROUND OF THE INVENTION

1. Field of the Invention

The present invention relates to a socket for feeding electric power to electric appliances and the like, and more particularly to a socket provided with a plug locking mechanism for preventing a plug from falling off from the socket in case of electrically connecting the plug having a cord connected with an electric appliance or the like with the socket.

2. Description of the Related Art

Details of a conventional socket have been disclosed in a Japanese Kokai No. Sho 56-13678, for example.

The conventional socket has a plate member, a receptacle part, a pair of projecting parts, and a tap. The plate member has an opening at a specified position thereof. The receptacle part is embedded in and fixed to the plate member so as to expose its obverse face from the opening of the plate member. The pair of projecting parts are respectively fixed on both sides of the receptacle, namely, on both sides of the opening of the plate member. Each of the projecting .parts is made of an elastic member and has an inwardly oriented claw on its top end. The tap has a receptacle part on its upper surface as well as a pair of plug blades projecting downward on its bottom surface. This tap is provided with shoulder parts to be freely engaged with and released from the pair of projecting parts on both sides thereof.

Connecting operation of the conventional socket is described below.

First, a pair of plug blades provided on the lower surface of the tap are inserted into the receptacle part fixed on the plate member. Next, the tap is fixed on the plate member by engaging the claws of the pair of projecting parts set on the obverse face of the plate member on both sides of the receptacle part with the shoulder parts provided on both sides of the tap. Lastly, electrical connection is finished by inserting a plug having a cord of another electric appliance into the receptacle part provided on the upper surface of the tap.

However, the above-mentioned conventional socket has the following problems.

First, the conventional socket must have some special retaining mechanisms, for example, projecting parts and shoulder parts provided on both of the plate member and the tap in advance in order to prevent the tap from falling off from the plate member.

Second, since a plug with a cord of another electric appliance is simply inserted into the receptacle part provided on the upper surface of the tap, the plug with a cord easily falls off from the receptacle part provided on the upper surface of the tap when a strong pulling force is applied to the cord connected with the electric appliance, Third, when using electric appliances whose plugs have cords with various shapes and sizes, the socket needs to be equipped with specific retaining mechanisms matching the shapes and sizes of the respective plugs with cords, and as a result it becomes poor in general usability as well as high in cost by taking much time and labor.

SUMMARY OF THE INVENTION

It is therefore an object of the present invention to eliminate the above-mentioned problems and to provide a socket with a plug locking mechanism which is comparatively inexpensive and excellent in general usability as well as which can completely prevent falling-off of a plug by providing the socket body provided with a simple mechanism for locking the plug.

According to the present invention, a socket with a plug locking mechanism has a socket body having an opening formed in a specified position. Plural receptacles for supplying electric power have their obverse faces exposed from the opening of the socket body and are electrically and mechanically connected with plural terminals projectingly formed on the top end of the plug. Plural projecting parts are formed on the socket body in one body having the same material as the socket body and keeping a specified interval between them on both sides of the opening of the socket body. Each of the plural projecting parts has at least one hole. A spring has a locking part to be engaged with the rear part of the plug in the middle part of the spring, and is set in the plural projecting parts so as to be freely turned by inserting both ends thereof respectively into the holes formed in the plural projecting parts.

BRIEF DESCRIPTION OF THE DRAWINGS

The above object and feature of this invention will become more apparent from the following description when taken in conjunction with the attached drawings in which.

In these figures, the same reference numerals denote similar elements, respectively.

DETAILED DESCRIPTION OF THE PREFERRED EMBODIMENTS

Next will be described embodiments of the present invention in detail according to the drawings.

Figure 1:
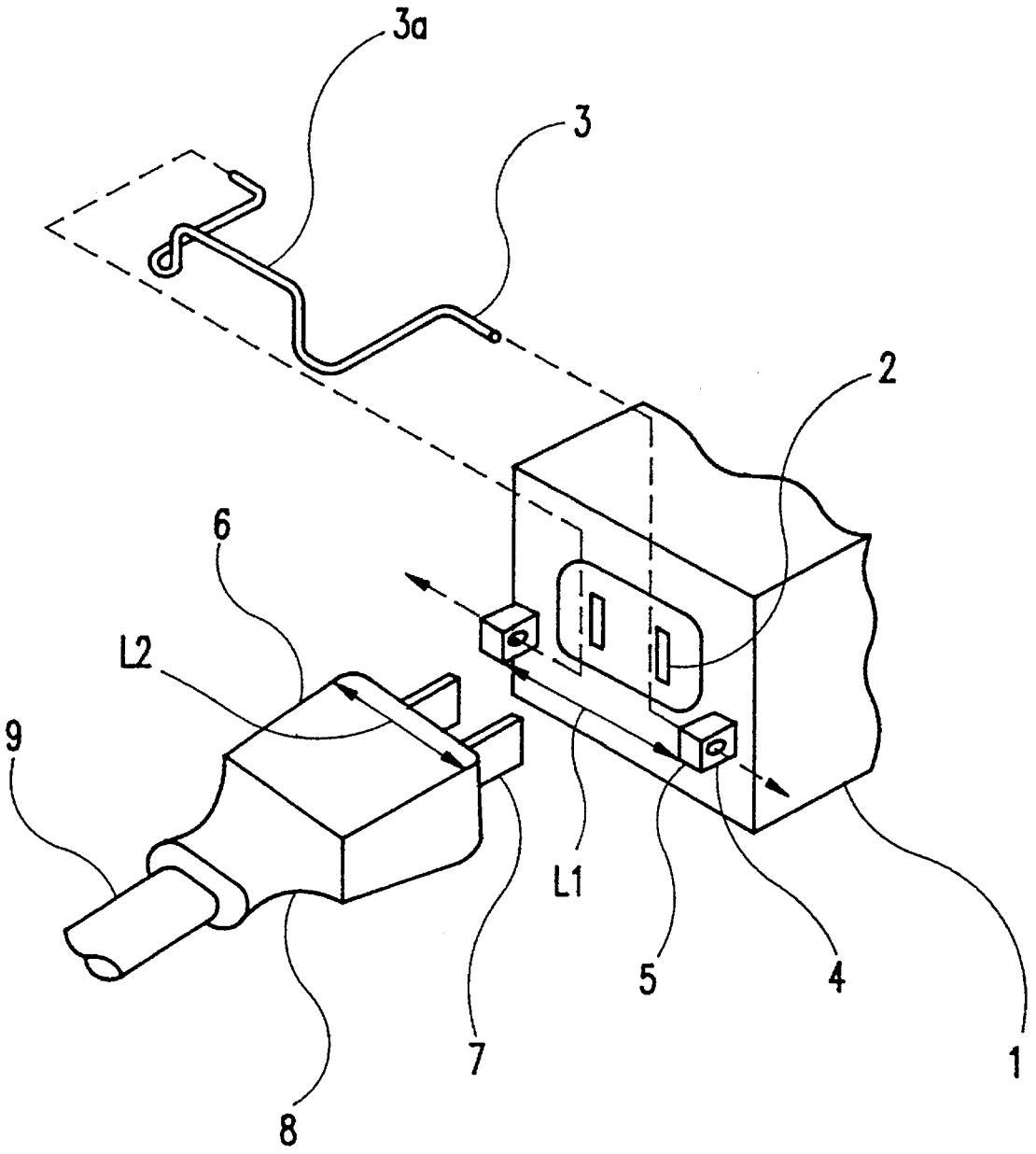
FIG. 1 is a perspective view of a first embodiment of the present invention.

Referring to FIG. 1, a first embodiment of the present invention has a socket body 1 formed having an opening in a specified position, plural receptacles 2 for supplying electric power to be electrically and mechanically connected with plural terminals provided on the top end of a plug 6 in which the obverse faces of the receptacles are exposed from the opening of the socket body 1, plural projecting parts 5 which are integrally formed on the socket body 1 and with the same material as the socket body 1 and which have a specified interval between them on both sides of the opening of the socket body 1 and each of which has one hole 4, and a spring 3 which has at an intermediate portion thereof a locking part *3a* to be engaged with the rear part 8 of the plug 6 and is set in the plural projecting parts 5 so as to be freely turned by inserting both ends of the spring respectively into the holes 4 formed in the plural projecting parts 5.

The socket body 1 has the plural receptacles 2 for supplying electric power embedded in it and has an opening for exposing the plural receptacles 2 for supplying electric power from the surface of the socket body 1.

The socket body 1 is made of a thermoplastic resin such as acrylonitrile-butadiene-styrene resin or polymethyl methacrylate which is one kind of methacrylic resin, for example.

The plug 6 is set at the top (e.g., first) end of a cord 9 for supplying electric power from the socket body 1 to an electric appliance. Plural terminals 7 projecting formed on the top end of the plug 6 to come into contact with the socket body 1 are electrically and mechanically connected with the plural receptacles 2 for supplying electric power by being inserted into them. A rear part 8 of the plug 6 is formed in a connecting part between the plug 6 and the cord 9.

The plural projecting parts 5, each of which has one hole 4, are integrally formed on the socket body 1 with the same material as the socket body 1. Therefore, the plural projecting parts 5 also are made of a thermoplastic resin such as acrylonitrile-butadiene-styrene resin or polymethyl methacrylate which is one kind of methacrylic resin, for example. Interval L1 between the plural projecting parts 5 is made slightly wider than width L2 of the plug 6. For example, the interval L1 between the plural projecting parts is about 30 mm and the width L2 of the plug 6 is about 25 mm.

The spring 3 is made by first forming it nearly into the shape of U as a while. Then, a locking part 3*a* to be engaged with the rear part 8 of the plug 6 is formed by bending the middle part of the spring. Lastly both end parts of the spring to be inserted into the holes 4 of the respective projecting parts 5 are formed by bending both end parts respectively of the spring in the directions opposite to each other. The spring 3 is made of a stainless steel wire of about 2 mm or less in diameter, for example.

Figure 2:
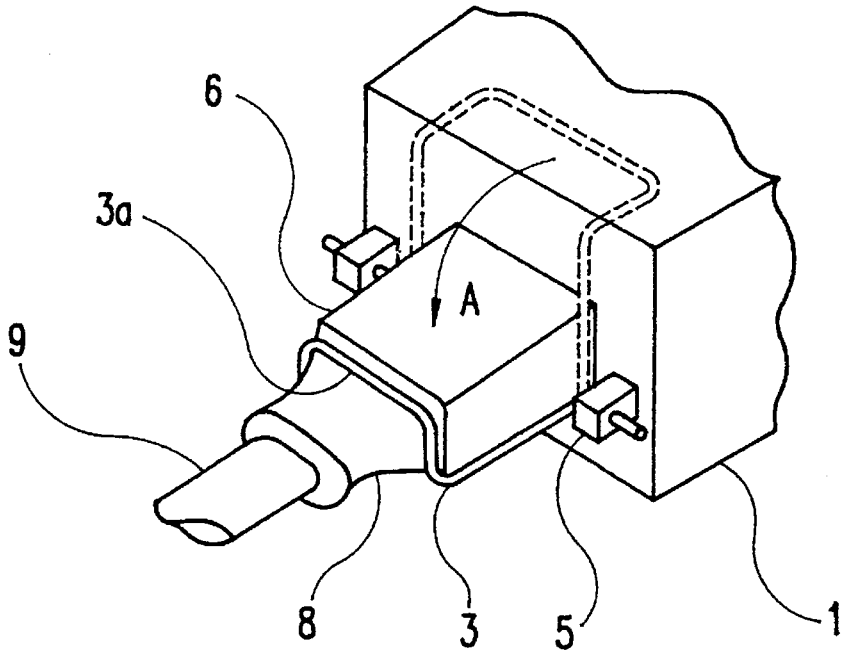
FIG. 2 is an explanatory drawing showing an operation for connecting a socket body and a plug with each other shown in FIG. 1.

Referring to FIGS. 1 and 2, an operation for connecting the plug 6 with the socket body 1 in the first embodiment is described below.

First, the spring 3 is set in the socket body 1 so as to be freely turned by inserting both end parts of the spring 3 into the holes 4 of the respective projecting parts 5. The spring 3 is lifted above the socket body 1 so as not to interfere with an operation of connecting the plug 6 with the socket body 1 and maintained in this condition.

Next, after positioning respectively the plural terminals 7 provided on the top end of the plug 6 and the plural receptacles 2 for supplying electric power exposed from the surface of the socket body 1, the plug 6 is moved to the socket body 1. Next, the socket body 1 and the plug 6 are electrically and mechanically connected with each other by inserting respectively the plural terminals 7 of the plug 6 into the plural receptacles 2 for supplying electric power.

At this time, the spring 3 is turned (e.g., pivoted) in the direction of arrow along an axis passing through the holes 4 of the projecting parts 5 as the central axis. Falling off of the plug 6 from the socket body 1 is prevented by engaging at last the locking part 3*a* formed by bending the middle part of the spring 3 in the shape of U with the rear part 8 of the plug 6.

In this manner, the first embodiment can completely prevent a plug from falling off from a socket body due to a pulling force applied to a cord, since the socket body 1 has a plug locking mechanism having plural projecting parts 5 integrally formed on the socket body 1 with the same material as the socket body 1 and a spring which has a locking part 3*a* to be engaged with the rear part 8 of the plug and is set in the plural projecting parts 5 at both its ends so as to be freely turned.

Figure 3:
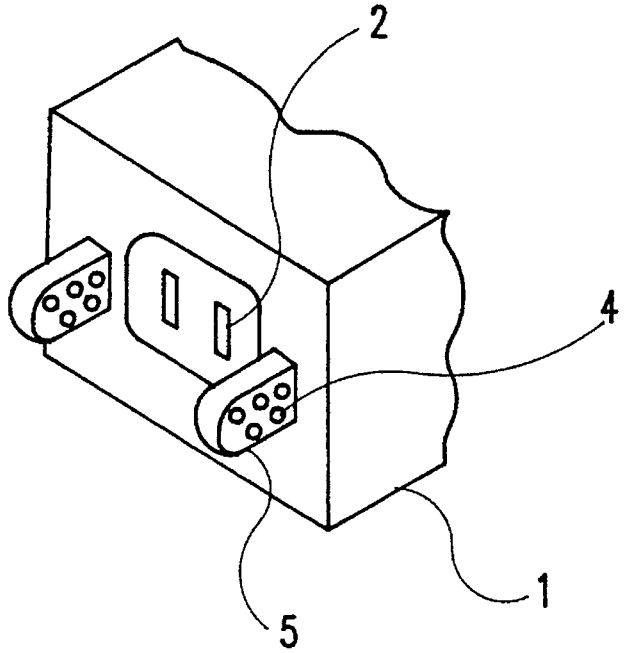
FIG. 3 is a perspective view of a second embodiment of the present invention.

Referring to FIG. 3, in addition to the same composition as the first embodiment, a second embodiment of the invention is provided with plural projecting parts 5 which are formed on the socket body 1 with the same material as the socket body 1 as keeping a specified interval between them on both sides of an opening of a socket body 1 and each of which has plural holes 4.

Now, it is supposed to use an electric appliance having a plug 6 different in shape and size. At this time, a hole 4 which is most suitable in shape and size for the plug to be used is found out among the plural holes 4 of each projecting part 5, and the spring 3 is set in the projecting parts so as to be freely turned by inserting both end parts of the spring 3 into the most suitable holes 4.

Thus, in the second embodiment, by making plural holes in each of plural projecting parts which are formed on a socket body in one body with the same material as the socket body, it is made possible to find out a hole most suitable in shape and size for a plug to be used among the holes of each of the projecting parts and to set both end parts of a spring in the projecting parts so as to be freely turned in case of connecting the plug different in shape and size with the socket body. As a result, the socket with the plug locking mechanism can be greatly improved in general usability as well as lowered in cost by eliminating much time and labor of extensively changing design of the socket according to the shape and size of a plug.

As described above, a socket with a plug locking mechanism can completely prevent a plug from falling off from the socket body even if a pulling force is applied to a cord from some cause, since the socket body has a plug locking mechanism having plural projecting parts which are integrally formed on the socket body with the same material as the socket body and a spring which has a locking part to be engaged with the rear part of the plug and is set in the plural projecting parts so as to be freely turned.

Although the present invention has been fully described by way of the preferred embodiments thereof with reference to the attached drawings, various changes and modifications will be apparent to those having skill in this field without departing from the scope of the present invention, as defined by the appended claims.

What is claimed is:

1. A socket with a plug locking mechanism and for receiving a plug, said plug including a first end, a second end, a rear part at said first end, and a terminal projecting from said second end, said socket comprising:

a socket body having a first surface and an opening on said first surface for receiving said terminal of said plug;

a receptacle provided in said body for supplying electric power to said terminal of said plug when said terminal is inserted in said opening of said socket body;

first and second projecting pans provided on said first surface of said socket body, each of said first and second projecting parts having a plurality of holes; and a spring having a first end, a second end, and a locking part coupled between said first and second ends thereof, said first end of said spring being positioned in one of said plurality of holes of said first projecting part, said second end of said spring being positioned in one of said plurality of holes of said second projecting part, said spring being rotatably movable in first and second positions about an axis between said first and second ends thereof, said locking part engaging said rear part of said socket when said spring is positioned in said first position.

2. A socket according to claim 1, wherein one of said plurality of holes of said first projecting pan has a same axis as one of said plurality of holes of said second projecting part.

3. A socket according to claim 1, wherein an interval between said first and second projecting parts is minimally greater than a width of said plug.

4. A socket according to claim 1, wherein said socket body comprises thermoplastic resin.

5. A socket according to claim 4, wherein said thermoplastic resin comprises acrylonitrile-butadiene-styrene resin.

6. A socket according to claim 4, wherein said thermoplastic comprises polymethyl methacrylate.

7. A socket according to claim 1, wherein said socket body, said first projecting part, and said second projecting part are integrally formed.

8. A socket according to claim 1, wherein said spring includes:

first and second bent portions adjacent said first and second ends, respectively; and a substantially U-shaped intermediate portion connected to said first and second bent portions, a part of said intermediate portion forming said locking part.

9. A socket according to claim 1, wherein said first and second ends of said spring are selectively positionable in holes of said first and second projecting parts, respectively, such that plugs having different dimensions are retainable by said spring.

10. A socket according to claim 1, wherein each of said plurality of holes are located a different distance away from said first surface of said socket body.

* * * * *